US008564208B2

(12) United States Patent
Jou

(10) Patent No.: US 8,564,208 B2
(45) Date of Patent: Oct. 22, 2013

(54) LIGHTING DEVICE WITH COLOR TEMPERATURE ADJUSTING FUNCTIONALITY

(75) Inventor: Jwo-Huei Jou, Taipei (TW)

(73) Assignee: National Tsing Hua University, Hsinchu (TW)

( * ) Notice: Subject to any disclaimer, the term of this patent is extended or adjusted under 35 U.S.C. 154(b) by 364 days.

(21) Appl. No.: 13/184,730

(22) Filed: Jul. 18, 2011

(65) Prior Publication Data

US 2012/0299491 A1 Nov. 29, 2012

(30) Foreign Application Priority Data

May 25, 2011 (TW) ..... 100118246 A

(51) Int. Cl.
*H05B 35/00* (2006.01)
*H05B 37/02* (2006.01)

(52) U.S. Cl.
USPC ..... 315/178; 315/291

(58) Field of Classification Search
USPC ..... 315/178, 291; 307/11
See application file for complete search history.

(56) References Cited

U.S. PATENT DOCUMENTS 6,411,046 B1 * 6/2002 Muthu ..... 315/309
6,441,558 B1 * 8/2002 Muthu et al. ..... 315/149
7,319,298 B2 * 1/2008 Jungwirth et al. ..... 315/307
7,800,315 B2 * 9/2010 Shteynberg et al. ..... 315/291
7,956,554 B2 * 6/2011 Shteynberg et al. ..... 315/293
8,040,075 B2 * 10/2011 Horino ..... 315/291
8,253,349 B2 * 8/2012 Shteynberg et al. ..... 315/291
8,253,666 B2 * 8/2012 Shteynberg et al. ..... 345/82
8,264,448 B2 * 9/2012 Shteynberg et al. ..... 345/102
8,368,636 B2 * 2/2013 Shteynberg et al. ..... 345/102
8,436,549 B2 * 5/2013 Hasnain ..... 315/291
2004/0130518 A1 * 7/2004 De Krijger et al. ..... 345/83
2009/0108772 A1 * 4/2009 Teng et al. ..... 315/294
2012/0038291 A1 * 2/2012 Hasnain ..... 315/294

* cited by examiner

*Primary Examiner* — Thuy Vinh Tran

(57) ABSTRACT

The present invention relates to a lighting device with color temperature adjusting functionality, comprising: a light-emitting device array module, a first driving unit, a second driving unit, a third driving unit, a fourth driving unit, a main controlling unit, and a power management unit, wherein the first driving unit, the second driving unit, the third driving unit, the fourth driving unit are used for respectively driving a first high color temperature light-emitting device array, a first low color temperature light-emitting device array, a second low color temperature light-emitting device array, and a second high color temperature light-emitting device array of the light-emitting device array module, so as to selectively drive a plurality of first high color temperature light-emitting devices, a plurality of first low color temperature light-emitting devices, a plurality of second low color temperature light-emitting devices, and a plurality of second high color temperature light-emitting devices to emit a color light with a specific color temperature.

17 Claims, 11 Drawing Sheets

LIGHTING DEVICE WITH COLOR TEMPERATURE ADJUSTING FUNCTIONALITY

CROSS-REFERENCE TO RELATED APPLICATION

This application claims foreign priority from a Taiwan Patent Application, Ser. No. 100118246, filed on May 25, 2011.

BACKGROUND OF THE INVENTION

1. Technical Field

The present invention relates to a lighting device, and more particularly, to a lighting device with color temperature adjusting functionality.

2. Description of Related Art

Recently, with the development of optoelectronics industry, more and more types of illumination device are proposed, in which the industry relating to the illumination device using LED chips as light-emitting devices thereof is regarded as star industry. According to manufacturing process, LED chips can be divided into high CT (color temperature) LED chips and low CT (color temperature) LED chips. If the illumination device uses the high CT LED chips as the light-emitting devices thereof, the light outputted by the illumination device called "cold light" (around 7000K); On the contrary, If the illumination device uses the low CT LED chips as the light-emitting devices thereof, the light outputted by the illumination device called "warm light" (around 3000K). So that, it is able to know that, whatever cold light or warm light, it is apparently divergent from the natural sunlight, and such divergence results in distinguishing sensibility for human eyes.

Accordingly, illumination device manufacturer make great efforts to fabricate and then propose a CT (color temperature) adjustable white light illumination device. A user is able to adjust the color temperature of the light outputted by the light illumination device. Please refer to FIG. 1, which illustrates a framework diagram of a conventional CT adjustable white light illumination device. As shown in FIG. 1, the CT adjustable white light illumination device 1' includes: an array, which is formed by crosswise arranging a plurality of first LED chips 2' and a plurality of second LED chips 3'. In the framework of the CT adjustable white light illumination device 1', the first LED chip 2' is able to emit a WW (warm white) light with the color temperature thereof ranging in 2500K-4000K, the second LED chip 3' is able to emit a CW (cold white) light with the color temperature thereof ranging in 6000K-10000K. Moreover, as shown in FIG. 1, the WW light 4' and CW light 5' are combined to an output light 6', wherein the color temperature of the output light 6' depends on the relative contribution proportion of the WW light 4' and CW light 5'.

So that, by way of crosswise arranging the plurality of first LED chips 2' and the plurality of second LED chips 3', the framework of the CT adjustable white light illumination device 1' is completed; Moreover, the user can use a controlling module (not shown in FIG. 1) to adjust the relative contribution proportion of the first LED chips 2' and the second LED chips 3', so as to make the CT adjustable white light illumination device 1' emit the output light 6' with a selected color temperature. Please refer to FIG. 2, which illustrates a framework diagram of a controlling module of the conventional CT adjustable white light illumination device. As shown in FIG. 2, the controlling module 20' used for controlling the first LED chips 2' and the second LED chips 3' includes a variable resistor Rw and a current source I, wherein the value of a first driving current $I_A$ and a second driving current $I_B$ can be adjusted by way of modulating the variable resistor Rw, such that the relative contribution proportions of the first LED chips 2' and the second LED chips 3' are adjusted.

Thus, through above descriptions, it is easily to know that the conventional CT adjustable white light illumination device 1' provides the function of color temperature adjustment to the user, and the user is able to adjust the color temperature of the light outputted by the CT adjustable white light illumination device 1' according to his preferences, so as to obtain a with light capable of comforting human eyes. However, the conventional CT adjustable white light illumination device 1' still has shortcomings and disadvantages as follows:

1. As shown in FIG. 1, the first LED chips 2' and the second LED chips 3' are arranged to an array and driven by the same current source I; thus, if the current source I is unable to work, all the first LED chips 2' and the second LED chips 3' are unable to emit light.
2. As shown in FIG. 2, in the framework of the conventional CT adjustable white light illumination device 1', the value of the first driving current $I_A$ and the second driving current $I_B$ are adjusted by way of modulating the variable resistor Rw, so as to adjust the relative contribution proportions of the first LED chips 2' and the second LED chips 3'; thus, it can know that, if the variable resistor Rw is unable to work, it can not adjust the relative contribution proportions of the first LED chips 2' and the second LED chips 3'.

Accordingly, in view of the conventional illumination device and the conventional CT adjustable white light illumination device still have shortcomings and drawbacks, the inventor of the present application has made great efforts to make inventive research thereon and eventually provided a lighting device with color temperature adjusting functionality.

BRIEF SUMMARY OF THE INVENTION

The primary objective of the present invention is to provide a lighting device with color temperature adjusting functionality, in which a plurality of first high CT (color temperature) light-emitting devices, a plurality of first low CT (color temperature) light-emitting devices, a plurality of second low CT (color temperature) light-emitting devices, and a plurality of second high CT (color temperature) light-emitting devices are arranged to a first high CT (color temperature) light-emitting device array, a first low CT (color temperature) light-emitting device array, a second low CT (color temperature) light-emitting device array, and a second high CT (color temperature) light-emitting device array, respectively; Moreover, a first driving unit, a second driving unit, a third driving unit, and a fourth driving unit are used for respectively controlling the first low CT light-emitting device array, the second low CT light-emitting device array, and the second high CT light-emitting device array, so as to selectively drive the plurality of first high CT light-emitting devices, the plurality of first low CT light-emitting devices, the plurality of second low CT light-emitting devices, and the plurality of second high CT light-emitting devices to emit light; Therefore, a color light with a specific color temperature is provided.

The another objective of the present invention is to provide a lighting device with color temperature adjusting functionality, in which a plurality of first high CT (color temperature)

light-emitting devices, a plurality of first low CT (color temperature) light-emitting devices, a plurality of second low CT (color temperature) light-emitting devices, and a plurality of second high CT (color temperature) light-emitting devices are arranged to a first high CT (color temperature) light-emitting device array, a first low CT (color temperature) light-emitting device array, a second low CT (color temperature) light-emitting device array, and a second high CT (color temperature) light-emitting device array, respectively; Moreover, a first driving unit, a second driving unit, a third driving unit, and a fourth driving unit are used for respectively controlling the first low CT light-emitting device array, the second low CT light-emitting device array, and the second high CT light-emitting device array; Thus, if there are one or two driving units unable to work, others driving units can still be used to control those connected light-emitting device array for driving the light-emitting devices to emit light.

Accordingly, to achieve the abovementioned objectives of the present invention, the inventor proposes a lighting device with color temperature adjusting functionality, comprising:

a first high CT (color temperature) light-emitting device array, having a plurality of first high CT (color temperature) light-emitting devices and adopted for emitting a first high CT (color temperature) light;

a first low CT (color temperature) light-emitting device array, having a plurality of first low CT (color temperature) light-emitting devices and adopted for emitting a first low CT (color temperature) light;

a second low CT (color temperature) light-emitting device array, having a plurality of second low CT (color temperature) light-emitting devices and adopted for emitting a second low CT (color temperature) light; and a second high CT (color temperature) light-emitting device array, having a plurality of second high CT (color temperature) light-emitting devices and adopted for emitting a second high CT (color temperature) light;

a first driving unit, coupled to the first high CT light-emitting device array and used for driving the plurality of first high CT light-emitting devices to emit light;

a second driving unit, coupled to the first low CT light-emitting device array and used for driving the plurality of first low CT light-emitting devices to emit light;

a third driving unit, coupled to the second low CT light-emitting device array and used for driving the plurality of second low CT light-emitting devices to emit light;

a fourth driving unit, coupled to the second high CT light-emitting device array and used for driving the plurality of second high CT light-emitting devices to emit light;

a main controlling unit, coupled to the light-emitting device array module, the first driving unit, the second driving unit, the third driving unit, and the fourth driving unit, wherein the main controlling unit is used for controlling the first driving unit, the second driving unit, the third driving unit, and the fourth driving unit to selectively drive the first high CT light-emitting devices, the first low CT light-emitting devices, the second low CT light-emitting devices, and the second high CT light-emitting devices emitting light, so as to make the light-emitting device array module output a color light with a specific color temperature; and a power management unit, coupled to the light-emitting device array module, the first driving unit, the second driving unit, the third driving unit, the fourth driving unit, and the main controlling unit and used for providing power to the light-emitting device array module, the first driving unit, the second driving unit, the third driving unit, the fourth driving unit, and the main controlling unit.

BRIEF DESCRIPTION OF THE SEVERAL VIEWS OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE INVENTION

To more clearly describe a lighting device with color temperature adjusting functionality according to the present invention, embodiments of the present invention will be described in detail with reference to the attached drawings hereinafter.

Figure 1:
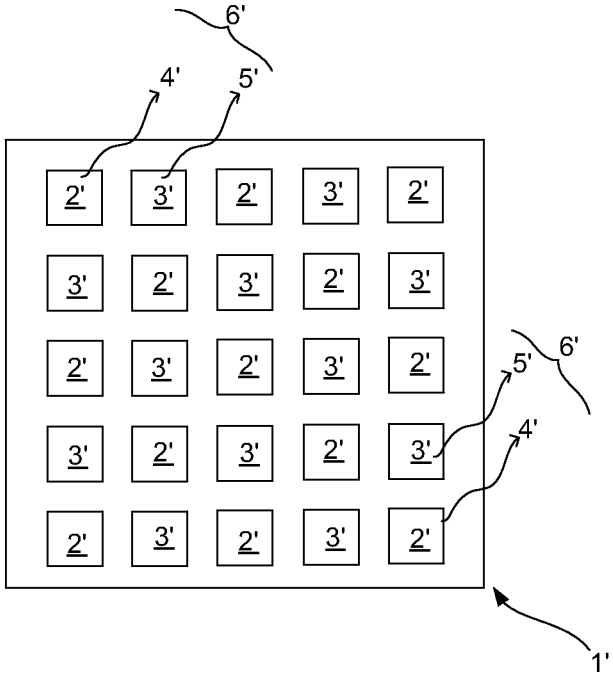
FIG. 1 (Prior Art)
FIG. 1 is a framework diagram of a conventional CT (color temperature) adjustable white light illumination device.
Figure 2:
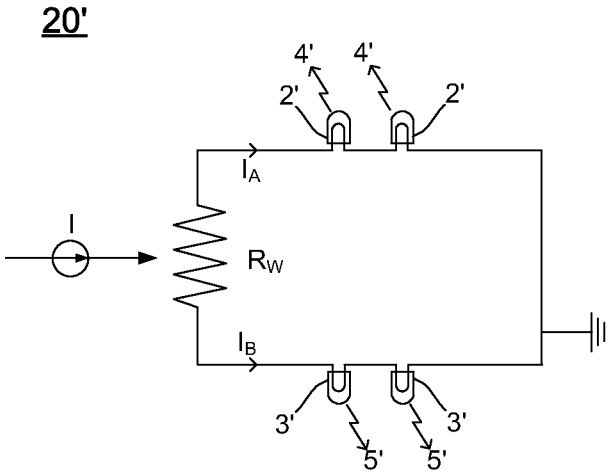
FIG. 2 (Prior Art)
FIG. 2 is a framework diagram of a controlling module of the conventional CT adjustable white light illumination device.
Figure 3:
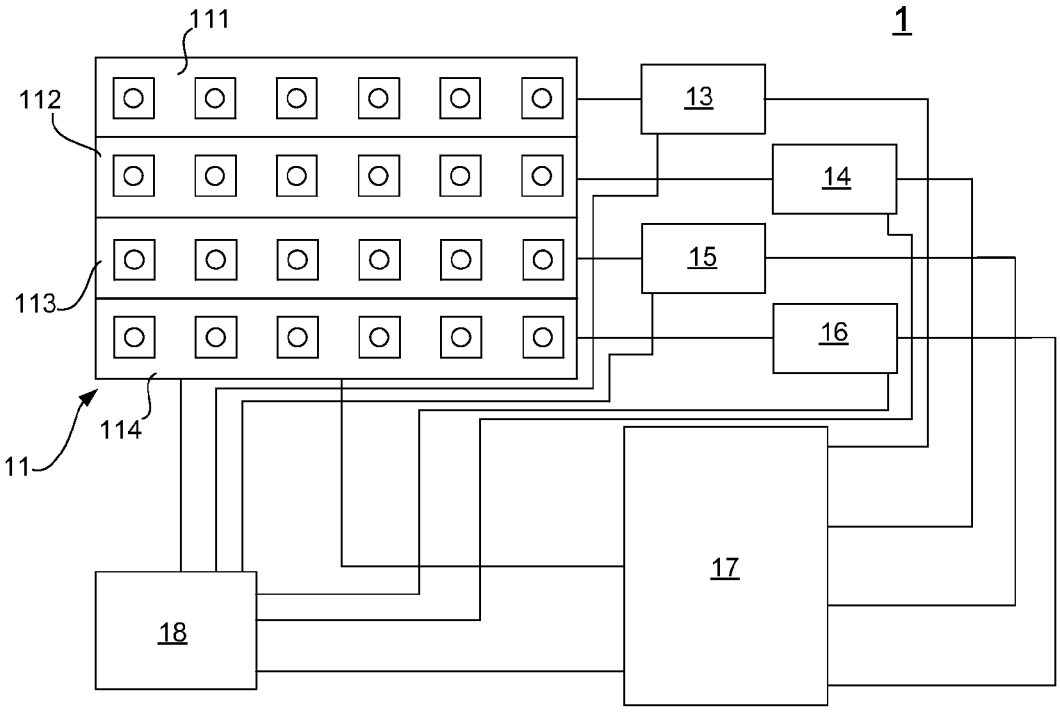
FIG. 3 is a framework view of a lighting device with color temperature adjusting functionality according to the present invention.

Please refer to FIG. 3, which illustrates a framework view of a lighting device with color temperature adjusting functionality according to the present invention. As shown in FIG. 3, the lighting device 1 with color temperature adjusting functionality includes: a light-emitting device array module 11, a first driving unit 13, a second driving unit 14, a third driving unit 15, a fourth driving unit 16, a main controlling unit 17, and a power management unit 18.

Figure 4A:
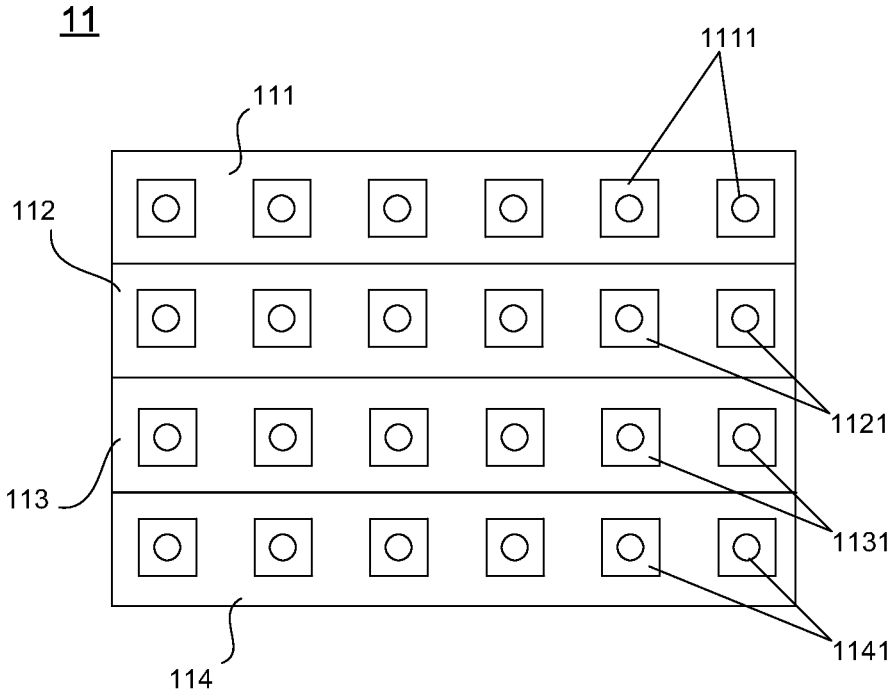
FIG. 4A is a first framework view of a light-emitting device array module of the lighting device with color temperature adjusting functionality.

Continuously referring to FIG. 3, and simultaneously referring to FIG. 4A, which illustrates a first framework view of the light-emitting device array module of the lighting device with color temperature adjusting functionality. As shown in FIG. 4A, the light-emitting device array module 11 includes: a first high CT (color temperature) light-emitting device array 111, having a plurality of first high CT (color temperature) light-emitting devices 1111 and adopted for emitting a first high CT (color temperature) light; a first low CT (color temperature) light-emitting device array 112, having a plurality of first low CT (color temperature) light-emitting devices 1121 and adopted for emitting a first low CT (color temperature) light; a second low CT (color temperature) light-emitting device array 113, having a plurality of second low CT (color temperature) light-emitting devices 1131 and adopted for emitting a second low CT (color temperature) light; and a second high CT (color temperature) light-emitting device array 114, having a plurality of second high CT (color temperature) light-emitting devices 1141 and adopted for emitting a second high CT (color temperature) light. In the framework of the light device 1 with color temperature adjusting functionality, it can selectively use the LED chip or the OLED chip as the first high CT light-emitting devices 1111, the first low CT light-emitting devices 1121, the second low CT light-emitting devices 1131, and the second high CT light-emitting devices 1141.

The aforesaid first driving unit 13 is coupled to the first high CT light-emitting device array 111 and used for driving the plurality of first high CT light-emitting devices 1111 to emit light. The second driving unit 14 is coupled to the first low CT light-emitting device array 112 and used for driving the plurality of first low CT light-emitting devices 1121 to emit light. The third driving unit 15 is coupled to the second low CT light-emitting device array 113 and used for driving the plurality of second low CT light-emitting devices 1131 to emit light. The fourth driving unit 16 is coupled to the second high CT light-emitting device array 114 and used for driving the plurality of second high CT light-emitting devices 1141 to emit light.

Figure 5:
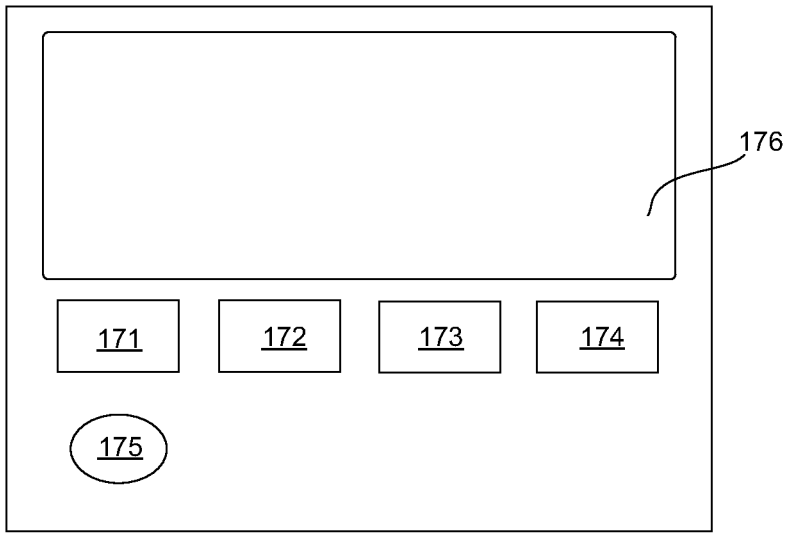
FIG. 5 is a framework view of a controlling unit of the lighting device with color temperature adjusting functionality.

Referring to FIG. 3 and FIG. 4A again, and simultaneously referring to FIG. 5, which illustrates a framework view of the controlling unit of the lighting device with color temperature adjusting functionality. As shown in FIG. 3 and FIG. 5, the main controlling unit 17 is coupled to the light-emitting device array module 11, the first driving unit 13, the second driving unit 14, the third driving unit 15, and the fourth driving unit 16, wherein the main controlling unit 17 is used for controlling the first driving unit 13, the second driving unit 14, the third driving unit 15, and the fourth driving unit 16, and including: a first controller 171, a second controller 172, a third controller 173, and a fourth controller 174, wherein the first controller 171, the second controller 172, the third controller 173, and the fourth controller 174 are used for controlling the first driving unit 13, the second driving unit 14, the third driving unit 15, and the fourth driving unit 16, respectively, so as to selectively drive the plurality of first high CT light-emitting devices 1111, the plurality of first low CT light-emitting devices 1121, the plurality of second low CT light-emitting devices 1131, and the plurality of second high CT light-emitting devices 1141 to emit light; Therefore, the light-emitting device array module 11 outputs a color light with a specific color temperature.

In addition, the power management unit 18 is coupled to the light-emitting device array module 11, the first driving unit 13, the second driving unit 14, the third driving unit 15, the fourth driving unit 16, and the main controlling unit 17 and used for providing power to the light-emitting device array module 11, the first driving unit 13, the second driving unit 14, the third driving unit 15, the fourth driving unit 16, and the main controlling unit 17.

Particularly, for the framework of the lighting device 1 with color temperature adjusting functionality according to the present invention, it utilizes the first driving unit 13, the second driving unit 14, the third driving unit 15, and the fourth driving unit 16 to selectively drive the plurality of first high CT light-emitting devices 1111, the plurality of first low CT light-emitting devices 1121, the plurality of second low CT light-emitting devices 1131, and the plurality of second high CT light-emitting devices 1141; Therefore, if there are one or two driving units unable to work, others driving units can still be used to control those connected light-emitting device array for driving the light-emitting devices to emit light. Besides, as shown in FIG. 5, the main controlling unit 17 further includes a display panel 176, which is adopted for displaying the color type and the current color temperature of the color light emitted by the light-emitting device array module 11.

Moreover, differing from the conventional CT adjustable white light illumination device, in the framework of the lighting device 1, the first high CT light-emitting devices 1111 of the first high CT light-emitting device array 111 are parallel to each other, the first low CT light-emitting devices 1121 of the first low CT light-emitting device array 112 are parallel to each other, the second low CT light-emitting devices 1131 of the second low CT light-emitting device array 113 are parallel to each other, and the second high CT light-emitting devices 1141 of the second high CT light-emitting device array 114 are parallel to each other. So that, if there are one or two first high CT light-emitting devices 1111 unable to work, others first high CT light-emitting devices 1111 can still be driven by the first driving unit 13 to emit the first high CT light; Or, if there are one or two first low CT light-emitting devices 1121 unable to work, others first low CT light-emitting devices 1121 can still be driven by the second driving unit 14 to emit the first low CT light.

Figure 4B:
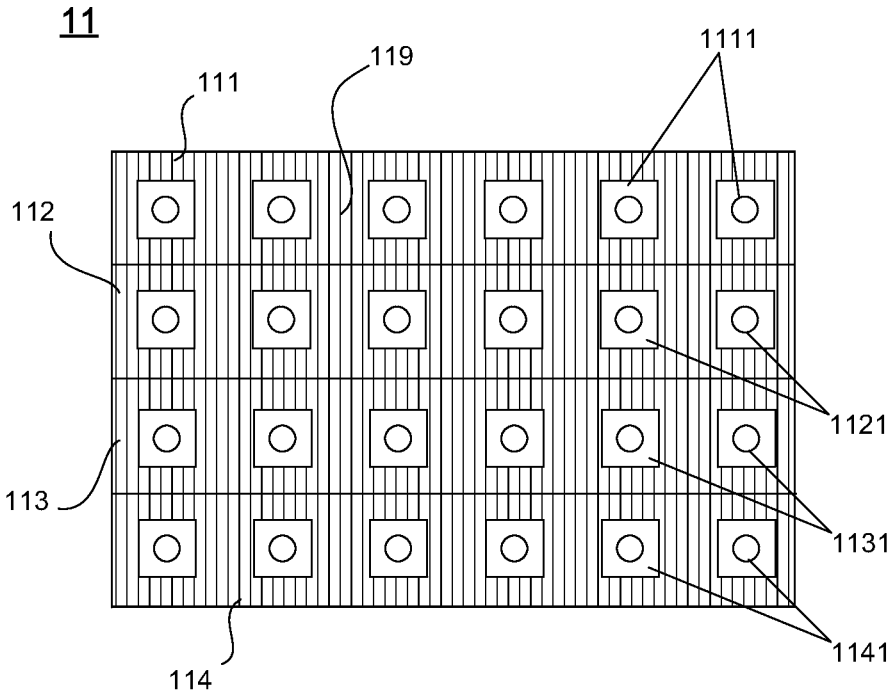
FIG. 4B is a second framework view of the light-emitting device array module of the lighting device with color temperature adjusting functionality.

Continuously referring to FIG. 3, FIG. 4A and FIG. 5*s*, and please simultaneously refer to FIG. 4B, which illustrates a second framework view of the light-emitting device array module of the lighting device with color temperature adjusting functionality. As shown in FIG. 4B, when really practicing the lighting device 1 with color temperature adjusting functionality of the present invention, a optics filter 119 can be disposed inside the light-emitting device array module 11, which is controlled by the main controlling unit 17 for covering the light-emitting surface of the light-emitting device array module 11, so as to filter a light having a specific wavelength within the color light outputted by the light-emitting device array module 11. Simply to explain that, as shown in FIG. 5, a user may use the main controlling unit 17 to control the optics filter 119 to show and cover the light-emitting surface of the light-emitting device array module 11.

Figure 6A:
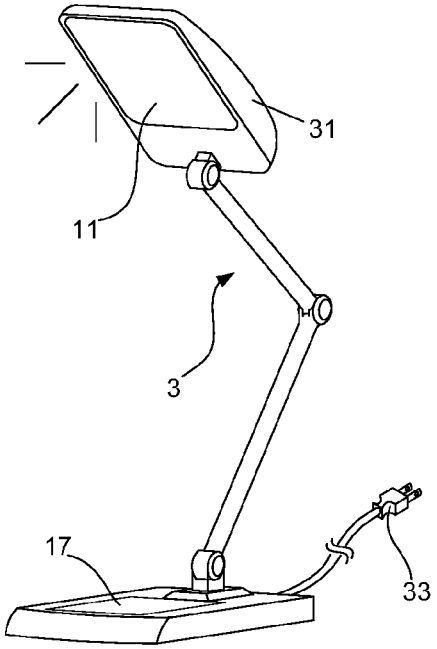
FIG. 6A and FIG. 6B are an exemplary embodiment for a desk lamp of the lighting device with color temperature adjusting functionality according to the present invention.

For more clearly describing the lighting device with color temperature adjusting functionality of the present invention, it will further introduce the lighting device through exemplary embodiments. Please refer to FIG. 6A and FIG. 6B, there are shown an exemplary embodiment for a desk lamp of the lighting device with color temperature adjusting functionality according to the present invention. As shown in FIG. 6A, the light-emitting device array module 11 is disposed inside a lampshade 31 of a desk lamp 3, the main controlling unit 17 is disposed on a base 32 of the desk lamp 3, and the power management unit 18 is provide in formation of a power supply with a power plug 33. Therefore, (as shown in FIG. 5) through the first controller 171, the second controller 172, the third controller 173, and the fourth controller 174, the user can selectively make the first high CT light-emitting devices 1111, the first low CT light-emitting devices 1121, the second low CT light-emitting devices 1131, and the second high CT light-emitting devices 1141 to emit light, such that the light-emitting device array module 11 would output the color light with the specific color temperature.

Figure 6B:
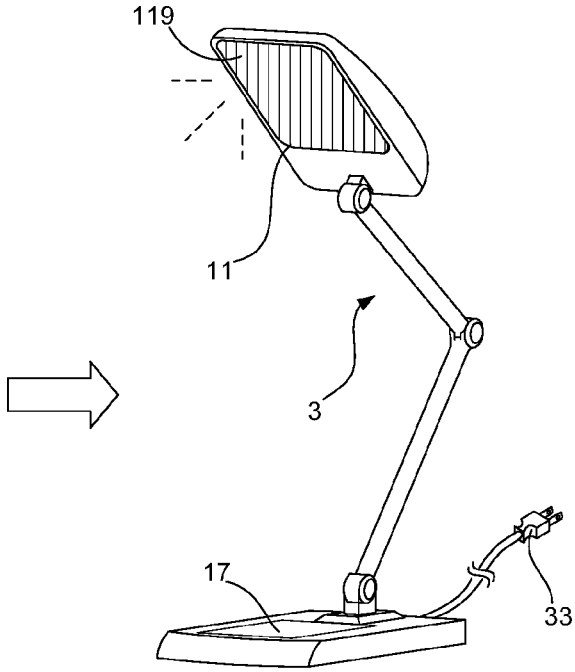

When the light-emitting device array module 11 in the lampshade 31 emits the color light with the specific color temperature, the user is able to know the color type and the current color temperature of the color light through the display panel 176 of the main controlling unit 17. Furthermore, as shown in FIG. 6B, if the user want to change the color type of the color light, it can operate the optics filter switch 175 of the main controlling unit 17 to control the optics filter 119 to show, then the light-emitting surface of the light-emitting device array module 11 is covered by the optics filter 119 and the light having the specific wavelength within the color light is filtered, therefore the color type of the color light is changed. Besides, the optics filter 119 can be doped with a fluorescence material, thus, when the optics filter 119 covers the light-emitting surface of the light-emitting device array module 11, the color light emitted by the light-emitting device array module 11 would input the optics filter 119, and then the fluorescence material would absorb partial color light and emit others color light, such that the color light outputted by the light-emitting device array module 11 may has plural color change.

Figure 7:
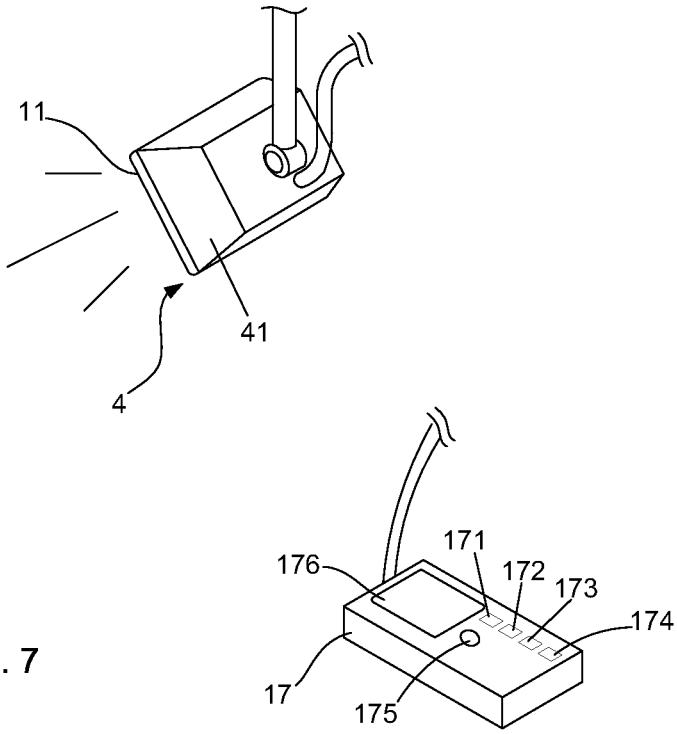
FIG. 7 is an exemplary embodiment for an illumination lamp of the lighting device with color temperature adjusting functionality according to the present invention.

Moreover, please refer to FIG. 7, which illustrates an exemplary embodiment for an illumination lamp of the lighting device with color temperature adjusting functionality according to the present invention. As shown in FIG. 7, the light-emitting device array module 11 is disposed inside a housing 41 of an illumination lamp 4, and the main controlling unit 17 is a controlling device. In this exemplary embodiment, if the controlling device (the main controlling unit 17) is fixed on the wall, the power management unit 18 is provide in formation of a power supply; On the other hand, if the main controlling unit 17 is a remote controlling device, the power management unit 18 is a battery installed inside the remote controlling device.

Figure 8:
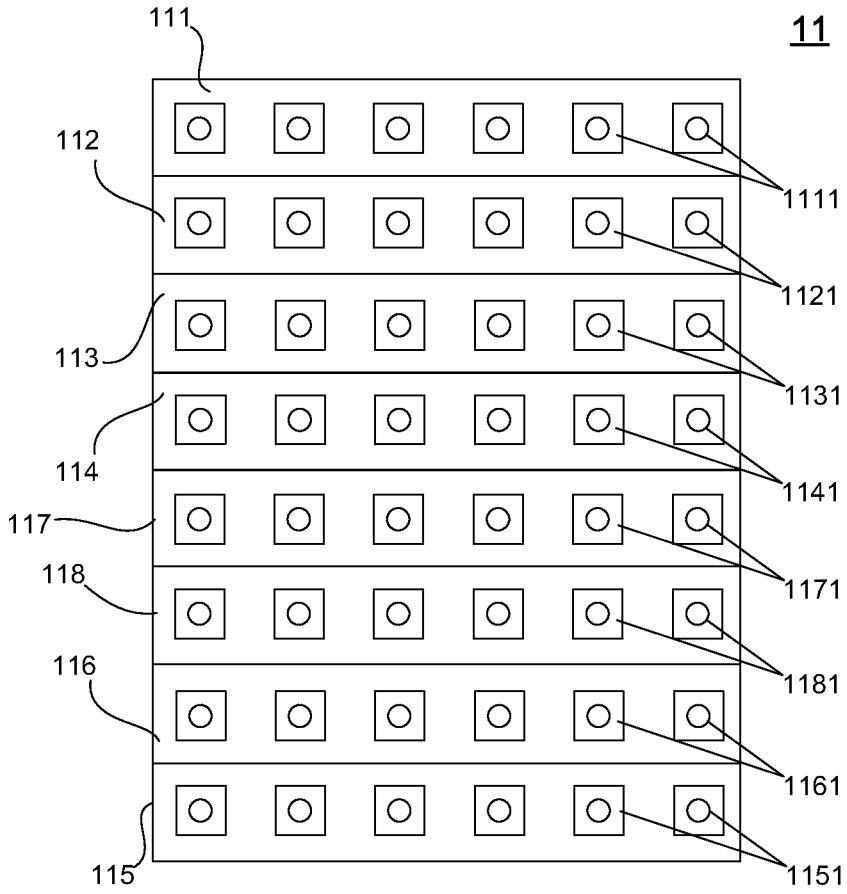
FIG. 8 is a third framework view of the light-emitting device array module of the lighting device with color temperature adjusting functionality.

Please continuously refer to FIG. 8, which illustrates a third framework view of the light-emitting device array module of the lighting device with color temperature adjusting functionality. For increasing the illumination of the lighting device with color temperature adjusting functionality of the present invention, and making the lighting device with color temperature adjusting functionality include more color temperature combination, as shown in FIG. 8, a third high CT (color temperature) light-emitting device array 115, a third low CT (color temperature) light-emitting device array 116, an N-th high CT (color temperature) light-emitting device array 117, and an N-th low CT (color temperature) light-emitting device array 118 are added into the light-emitting device array module 11, wherein the third high CT light-emitting device array 115 has a plurality of third high CT (color temperature) light-emitting devices 1151 and adopted for emitting a third high CT (color temperature) light, the third low CT light-emitting device array 116 has a plurality of third low CT (color temperature) light-emitting devices 1161 and adopted for emitting a third low CT (color temperature) light, the N-th high CT light-emitting device array 117 has a plurality of N-th high CT (color temperature) light-emitting devices 1171 and adopted for emitting an N-th high CT (color temperature) light, and the N-th low CT light-emitting device array 118 has a plurality of N-th low CT (color temperature) light-emitting devices 1181 and adopted for emitting an N-th low CT (color temperature) light.

Figure 9:
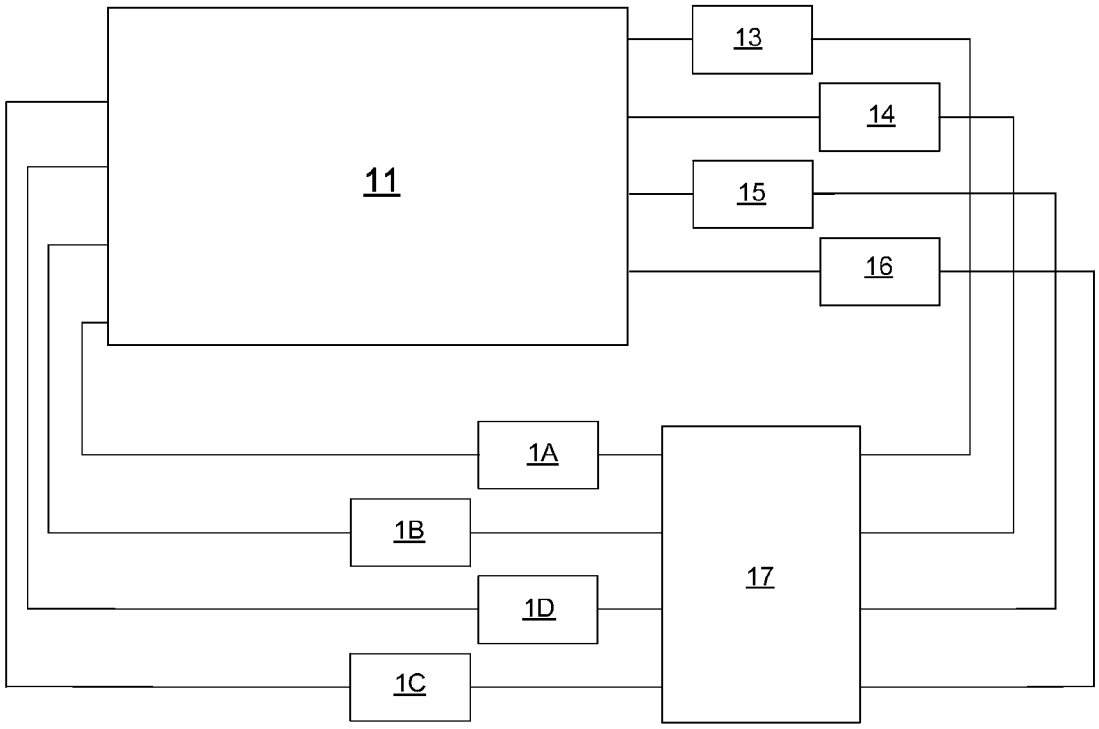
FIG. 9 is a second framework view of the lighting device with color temperature adjusting functionality according to the present invention.

Referring to FIG. 8 again, and please simultaneously refer to FIG. 9, which illustrates a second framework view of the lighting device with color temperature adjusting functionality according to the present invention; Moreover, please refer to FIG. 10, which illustrates a second framework view of the controlling unit of the lighting device with color temperature adjusting functionality. As shown in FIG. 8 and FIG. 9, since the third high CT light-emitting device array 115, the third low CT light-emitting device array 116, the N-th high CT light-emitting device array 117, and the N-th low CT light-emitting device array 118 are added into the light-emitting device array module 11, a fifth driving unit 1A, a sixth driving unit 1B, an N-th driving unit 1C, and a N+1-th driving unit 1D must be correspondingly added into the framework of the lighting device 1 with color temperature adjusting functionality. The fifth driving unit 1A is coupled to the third high CT light-emitting device array 115 and used for driving the plurality of third high CT light-emitting devices 1151 to emit light, the sixth driving unit 1B is coupled to the third low CT light-emitting device array 116 and used for driving the plurality of third low CT light-emitting devices 1161 to emit light, the N-th driving unit 1C is coupled to the N-th high CT light-emitting device array 117 and used for driving the plurality of N-th high CT light-emitting devices 1171 to emit light, and the N+1-th driving unit 1D is coupled to the N-th low CT light-emitting device array 118 and used for driving the plurality of N-th low CT light-emitting devices 1181 to emit light.

Figure 10:
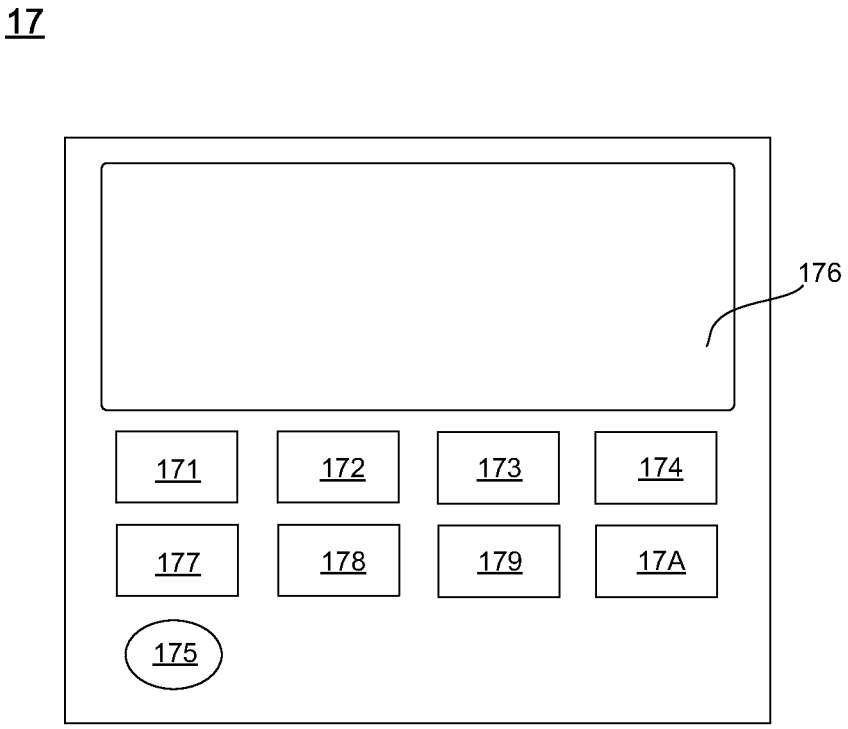
FIG. 10 is a second framework view of the controlling unit of the lighting device with color temperature adjusting functionality.

Please continuously refer to FIG. 8, FIG. 9 and FIG. 10, because the fifth driving unit 1A, the sixth driving unit 1B, the N-th driving unit 1C, and the N+1-th driving unit 1D are added into the framework of the lighting device 1, a fifth controller 177, a sixth controller 178, an N-th controller 179, and an N+1-th controller 17A also must be correspondingly added into the main controlling unit 17 for controlling the fifth driving unit 1A, the sixth driving unit 1B, the N-th driving unit 1C, and the N+1-th driving unit 1D, respectively.

The second framework of the lighting device with color adjusting functionality of the present invention has been introduced in above description and FIGS. 8-10. For the second framework, it not only increases the illumination of the lighting device with color temperature adjusting functionality but also make the lighting device with color temperature adjusting functionality include more color temperature combination.

Thus, through the above descriptions, the lighting device with color adjusting functionality of the present invention has been disclosed completely and clearly. In summary, the present invention has the following advantages:

1. In the present invention, a plurality of first high CT light-emitting devices, a plurality of first low CT light-emitting devices, a plurality of second low CT light-emitting devices, and a plurality of second high CT light-emitting devices are arranged to a first high CT light-emitting device array, a first low CT light-emitting device array, a second low CT light-emitting device array, and a second high CT light-emitting device array, respectively; Moreover, a first driving unit, a second driving unit, a third driving unit, and a fourth driving unit are used for respectively controlling the first low CT light-emitting device array, the second low CT light-emitting device array, and the second high CT light-emitting device array, so as to selectively drive the plurality of first high CT light-emitting devices, the plurality of first low CT light-emitting devices, the plurality of second low CT light-emitting devices, and the plurality of second high CT light-emitting devices to emit light; Therefore, a color light with a specific color temperature is provided.
2. Inheriting to above point 1, so that, if there are one or two driving units unable to work, others driving units can still be used to control those connected light-emitting device array for driving the light-emitting devices to emit light.
3. In the present invention, the first high CT light-emitting devices of the first high CT light-emitting device array are parallel to each other, the first low CT light-emitting devices of the first low CT light-emitting device array are parallel to each other, the second low CT light-emitting devices of the second low CT light-emitting device array are parallel to each other, and the second high CT light-emitting devices of the second high CT light-emitting device array are parallel to each other. So that, if there are one or two first high CT light-emitting devices unable to work, others first high CT light-emitting devices can still be driven by the first driving unit to emit the first high CT light; Or, if there are one or two first low CT light-emitting devices unable to work, others first low CT light-emitting devices can still be driven by the second driving unit to emit the first low CT light.

4. The present invention further provides an optics filter, which is controlled by the main controlling unit for covering the light-emitting surface of the light-emitting device array module, so as to filter a light having a specific wavelength within the color light outputted by the light-emitting device array module.

5. Inheriting to above point 4, the optics filter can be doped with a fluorescence material, thus, when the optics filter covers the light-emitting surface of the light-emitting device array module, the color light outputted by the light-emitting device array module would input the optics filter, and then the fluorescence material would absorb partial color light and emit others color light, such that the color light outputted by the light-emitting device array module may has plural color change.

The above description is made on embodiments of the present invention. However, the embodiments are not intended to limit scope of the present invention, and all equivalent implementations or alterations within the spirit of the present invention still fall within the scope of the present invention.

I claim:

1. A lighting device with color temperature adjusting functionality, comprising:

a light-emitting device array module, comprising:

a first high CT (color temperature) light-emitting device array, having a plurality of first high CT (color temperature) light-emitting devices and being adopted for emitting a first high CT (color temperature) light;

a first low CT (color temperature) light-emitting device array, having a plurality of first low CT (color temperature) light-emitting devices and being adopted for emitting a first low CT (color temperature) light;

a second low CT (color temperature) light-emitting device array, having a plurality of second low CT (color temperature) light-emitting devices and being adopted for emitting a second low CT (color temperature) light; and a second high CT (color temperature) light-emitting device array, having a plurality of second high CT (color temperature) light-emitting devices and being adopted for emitting a second high CT (color temperature) light;

a first driving unit, being coupled to the first high CT light-emitting device array and used for driving the plurality of first high CT light-emitting devices to emit light;

a second driving unit, being coupled to the first low CT light-emitting device array and used for driving the plurality of first low CT light-emitting devices to emit light;

a third driving unit, being coupled to the second low CT light-emitting device array and used for driving the plurality of second low CT light-emitting devices to emit light;

a fourth driving unit, being coupled to the second high CT light-emitting device array and used for driving the plurality of second high CT light-emitting devices to emit light;

a main controlling unit, being coupled to the light-emitting device array module, the first driving unit, the second driving unit, the third driving unit, and the fourth driving unit, wherein the main controlling unit is used for controlling the first driving unit, the second driving unit, the third driving unit, and the fourth driving unit to selectively drive the first high CT light-emitting devices, the first low CT light-emitting devices, the second low CT light-emitting devices, and the second high CT light-emitting devices emitting light, so as to make the light-emitting device array module output a color light with a specific color temperature; and a power management unit, being coupled to the light-emitting device array module, the first driving unit, the second driving unit, the third driving unit, the fourth driving unit, and the main controlling unit and used for providing power to the light-emitting device array module, the first driving unit, the second driving unit, the third driving unit, the fourth driving unit, and the main controlling unit.

2. The lighting device with color temperature adjusting functionality of claim 1, wherein the light-emitting device array module further comprises: at least one optics filter, which is controlled by the main controlling unit for covering the light-emitting surface of the light-emitting device array module, so as to filter a light having a specific wavelength within the color light outputted by the light-emitting device array module.

3. The lighting device with color temperature adjusting functionality of claim 2, wherein a fluorescence material is further doped in the optics filter.

4. The lighting device with color temperature adjusting functionality of claim 2, wherein the main controlling unit further comprises:

a first controller, being used for controlling the first driving unit;

a second controller, being used for controlling the second driving unit;

a third controller, being used for controlling the third driving unit;

a fourth controller, being used for controlling the fourth driving unit;

an optics filter switch, being used for controlling the optics filter to show, so as to cover the light-emitting surface of the light-emitting device array module and filter the light having the specific wavelength within the color light; and a display panel, being adopted for displaying the color type and the current color temperature of the color light emitted by the light-emitting device array module.

5. The lighting device with color temperature adjusting functionality of claim 1, wherein the light-emitting device array module further comprises:

a third high CT (color temperature) light-emitting device array, having a plurality of third high CT (color temperature) light-emitting devices and being adopted for emitting a third high CT (color temperature) light; and a third low CT (color temperature) light-emitting device array, having a plurality of third low CT (color temperature) light-emitting devices and being adopted for emitting a third low CT (color temperature) light.

6. The lighting device with color temperature adjusting functionality of claim 5, wherein the light-emitting device array module further comprises:

an N-th high CT (color temperature) light-emitting device array, having a plurality of N-th high CT (color temperature) light-emitting devices and being adopted for emitting an N-th high CT (color temperature) light; and an N-th low CT (color temperature) light-emitting device array, having a plurality of N-th low CT (color temperature) light-emitting devices and being adopted for emitting an N-th low CT (color temperature) light.

7. The lighting device with color temperature adjusting functionality of claim 6, further comprising:

an N-th driving unit, being coupled to the N-th high CT light-emitting device array and used for driving the plurality of N-th high CT light-emitting devices to emit light; and an N+1-th driving unit, being coupled to the N-th low CT light-emitting device array and used for driving the plurality of N-th low CT light-emitting devices to emit light.

8. The lighting device with color temperature adjusting functionality of claim 7, wherein the main controlling unit further comprises:

an N-th controller, being used for controlling the N-th driving unit; and an N+1-th controller, being used for controlling the N+1-th driving unit.

9. The lighting device with color temperature adjusting functionality of claim 6, wherein the N-th high CT light-emitting devices of the N-th high CT light-emitting device array are parallel to each other, and the N-th low CT light-emitting devices of the N-th low CT light-emitting device array being parallel to each other.

10. The lighting device with color temperature adjusting functionality of claim 5, further comprising:

a fifth driving unit, being coupled to the third high CT light-emitting device array and used for driving the plurality of third high CT light-emitting devices to emit light; and a sixth driving unit, being coupled to the third low CT light-emitting device array and used for driving the plurality of third low CT light-emitting devices to emit light.

11. The lighting device with color temperature adjusting functionality of claim 10, wherein the main controlling unit further comprises:

a fifth controller, being used for controlling the fifth driving unit; and a sixth controller, being used for controlling the sixth driving unit.

12. The lighting device with color temperature adjusting functionality of claim 5, wherein the third high CT light-emitting devices of the third high CT light-emitting device array are parallel to each other, and the third low CT light-emitting devices of the third low CT light-emitting device array being parallel to each other.

13. The lighting device with color temperature adjusting functionality of claim 1, wherein the first high CT light-emitting device is selected from the group consisting of: LED chip and OLED chip.

14. The lighting device with color temperature adjusting functionality of claim 1, wherein the second high CT light-emitting device is selected from the group consisting of: LED chip and OLED chip.

15. The lighting device with color temperature adjusting functionality of claim 1, wherein the first low CT light-emitting device is selected from the group consisting of: LED chip and OLED chip.

16. The lighting device with color temperature adjusting functionality of claim 1, wherein the second low CT light-emitting device is selected from the group consisting of: LED chip and OLED chip.

17. The lighting device with color temperature adjusting functionality of claim 1, wherein the first high CT light-emitting devices of the first high CT light-emitting device array are parallel to each other, the first low CT light-emitting devices of the first low CT light-emitting device array being parallel to each other, the second low CT light-emitting devices of the second low CT light-emitting device array being parallel to each other, and the second high CT light-emitting devices of the second high CT light-emitting device array being parallel to each other.

* * * * *